US006979269B1

(12) United States Patent
Nohara

(10) Patent No.: US 6,979,269 B1
(45) Date of Patent: Dec. 27, 2005

(54) COMBINATION CHIPPER AND PUTTER GOLF CLUB

(76) Inventor: Eizo Nohara, 3058 N. Skywood St., Orange, CA (US) 92865

( * ) Notice: Subject to any disclaimer, the term of this patent is extended or adjusted under 35 U.S.C. 154(b) by 0 days.

(21) Appl. No.: 10/871,781

(22) Filed: Jun. 18, 2004

(51) Int. Cl.[7] ..... A63B 53/02
(52) U.S. Cl. ..... 473/244; 473/325; 473/313; 473/245; 473/251
(58) Field of Search ..... 473/325, 340, 473/244–251, 313

(56) References Cited

U.S. PATENT DOCUMENTS

| | | | | | |
|---|---|---|---|---|---|
| 670,522 | A | | 3/1901 | Thompson | |
| 1,219,417 | A | | 3/1917 | Vories | |
| 1,429,569 | A | | 9/1922 | Craig | |
| 2,305,270 | A | | 12/1942 | Nilson | |
| 2,336,405 | A | * | 12/1943 | Kent | 473/245 |
| 2,530,446 | A | * | 11/1950 | Beardsley | 473/245 |
| 2,571,970 | A | | 10/1951 | Verderber | |
| 2,777,694 | A | | 1/1957 | Winter | |
| 2,882,053 | A | | 4/1959 | Lorthios | |
| 3,206,206 | A | * | 9/1965 | Santosuosso | 473/248 |
| 3,601,399 | A | | 8/1971 | Agens et al. | |
| 4,171,108 | A | * | 10/1979 | Ishida et al. | 242/231 |
| 4,506,888 | A | * | 3/1985 | Nardozzi, Jr. | 473/307 |
| 4,778,180 | A | * | 10/1988 | Guenther | 473/248 |
| 4,878,666 | A | | 11/1989 | Hosoda | |
| 5,133,553 | A | | 7/1992 | Divnick | |
| D346,191 | S | | 4/1994 | Bryant | |
| 5,458,335 | A | | 10/1995 | Hattori | |
| 5,538,245 | A | | 7/1996 | Moore | |
| 5,584,769 | A | | 12/1996 | Sundin | |
| 6,206,788 | B1 | | 3/2001 | Krenzler | |
| 6,348,007 | B2 | | 2/2002 | Kawasaki et al. | |
| 6,695,708 | B2 | | 2/2004 | Fisher | |
| 2002/0198060 | A1 | | 12/2002 | Fisher | |
| 2003/0060301 | A1 | | 3/2003 | Hsu | |

* cited by examiner

*Primary Examiner*—Sebastiano Passaniti
(74) *Attorney, Agent, or Firm*—Walter A. Hackler

(57) ABSTRACT

A combination chipper and putter golf club has a club head with a ball putting side surface and an opposing ball chipping side surface. The club head has a bore formed perpendicularly therethrough which receives a tube extension fixed to a hosel short depending shaft. Hosel orientation detents are provided by an opposing pair of detent notches formed into the tube extension lower end which fit onto a raised portion of a plug closing the bottom of the bore. A tension spring installed through the hosel tube extension is rotatably connected between the hosel pivot shaft and the bore bottom plug to hold the hosel tightly to the club head while permitting the hosel to be lifted sufficiently to retract the tube extension detent notches from the plug raised portion so that the hosel can be reoriented 180 degrees relative to the club head according to which chipping or putting surface is to be used. Alternatively hosel detents are formed at the top of the club head for use with the tension spring. In variations, a compression spring and a magnet are used in place of the tension spring.

21 Claims, 5 Drawing Sheets

COMBINATION CHIPPER AND PUTTER GOLF CLUB

BACKGROUND OF THE INVENTION

1. Field of the Invention

The present invention relates generally to the field of sporting equipment, more particularly to the field of golf equipment, and still more particularly to the field of golf clubs.

2. Background Discussion

The game or sport of golf is extremely popular in many parts of the world. To many players, golf is not so much a sport as an obsession and a significant personal challenge. Many players choose to live on or near a golf course and plan their vacations around golf.

The popularity of golf is further evidenced by the great variety of golf clubs and related golf equipment, such as golf shoes and other articles of golf clothes, sold in golf course pro shops and golf equipment stores. Golf clubs are of course the most important of all the golf equipment and are very susceptible to individual taste, which accounts for the great variety of clubs available and the constant introduction of "new and improved" golf clubs.

As is generally known, a full set of golf clubs constitute about three "woods" having relatively massive club heads (which may now be constructed from a metal, such as titanium) with different face angles, and which ate usually used for teeing off. In addition to the several "woods", a golf club set includes a number, typically at least about six, "irons" having different face angles and used for fairway shots and to get out of sand traps. At least in the past, "irons" were given quaint names, associated with different face angles and club numbers. For example, a relatively small angle 3 "iron" has been named a "mashie iron," a slightly more angled 4 "iron" has been named a "jigger," a more angled 6 "iron" has been named a "mashie niblick" and a still more angled 7 "iron" has been named a "niblick." The last member of a golf club set is the "putter" is used on the greens to "putt" the ball into the cup.

In any event, a full set of golf clubs is not only expensive, and very often quite expensive, but is heavy, thus often requiring a ridable, electric powered golf cart or at least a hand pushed or pulled golf cart. For travelers or vacationers, the lugging about of a golf bag holding a full set of golf clubs, especially through crowded airline terminals with their security check points, is an unpleasant and tiring chore.

In an apparent attempt to solve such problems, multi-purpose golf club "irons" have been developed and marketed. These multi-purpose "irons," (exemplified by U.S. Pat. No. 6,348,009, issued Feb. 19, 2002 to Louis Dischler; U.S. Pat. No. 6,206,788, issued Mar. 27, 2001 to Leo M. Krenzler; U.S. Pat. No. 5,538,245, issued Jul. 23, 1996 to Donald D. Moore; U.S. Pat. No. 5,113,533, issued Jul. 28, 1992 to Steven M. Divnick; U.S. Pat. No. 3,601,399, issued Aug. 24, 1971 to Martyn L. Ageos et al.; U.S. Pat. No. 4,878,866, issued Nov. 7, 1989 to Rukoro Hosoda; U.S. Pat. No. 2,882,053, issued Apr. 14, 1959 to M. Lorthiois; U.S. Pat. No. 2,777,694, issued Jan. 15, 1957 to C. V. Winter; U.S. Pat. No. 2,571,970, issued Oct. 16, 1951 to J. Verderber; U.S. Pat. No. 2,305,270, issued Dec. 15, 1942 to J. L. Nilson; U.S. Pat. No. 1,219,417, issued Mar. 13, 1917 to L. H. Voties; U.S. Pat. No. 670,522, issued Mar. 26, 2001 to E. F. Thompson) disclose a multi-purpose club head that is pivotally attached to a club hosel for incremental pivoting through angular positions corresponding to loft angles of individual golf clubs in a conventional set of "irons."

Selected club head angles are set by gear or other detent mechanisms and are typically locked in selected loft angle positions by manually operated screws. These loft angle setting and locking mechanisms can be expected to become difficult to operate as the multi-purpose club head becomes dirty and possibly rusty in ordinary use on golf courses.

Although the above-cited patents of Krenzler, Agens, Winter, Lorthiois and Moore provide club number markings at loft angle settings corresponding to the marked club numbers others do not and proper loft angle settings must be guessed at.

Although such multi-purpose clubs appear to offer some advantages over sets of "irons" in terms of cost and convenience, there are disadvantages to having a single multi-purpose club head settable at different loft angles. For example, golf ball striking surfaces of sets of "irons" vary from club to club, with higher numbered clubs with greater loft angles typically have larger-area club faces. In addition, shaft lengths of different numbered "irons" typically have different lengths, with higher numbered "irons" usually having shafts of decreasing length since the clubs are used for different purposes and are held differently by golfers. Thus, the single shaft length provided by the disclosed multi-purpose clubs is a distinct disadvantage. Still further, different club heads in a set of "irons" may vary slightly in weight, as opposed to the single club head in a multi-purpose "iron."

The end result is that each club in a set of "irons" will typically have at least a slightly different "feel" to which a golfer becomes used and is comfortable with. Consequently, multi-purpose golf clubs of the disclosed type have not gained wide acceptance by golfers, many of whom also prefer the status of having complete sets of expensive "irons."

In a less ambitious manner the U.S. Pat. No. 6,695,708, issued Feb. 24, 2004 to Dale P. Fisher and Publication No. U.S. 2002/0198060, (also Dale P. Fisher) published Dec. 26, 2002 disclose a triple-purpose golf club having a triangular club head with three different ball striking surfaces and a single, vertically mounted shaft. The present inventor considers such three-faced golf clubs to be very awkward to use and very impractical.

On the other hand, Publication No. U.S. 2003/0060301, (Yung-Ho Hsu) published Mar. 27, 2003 and U.S. Pat. No. 5,584,769, issued Dec. 17, 1996 to Donald C. Sundin; U.S. Pat. No. 5,458,335, issued Oct. 17, 1995 to Noriyasu Hattori; and Des. 346,191, issued Apr. 19, 1994 to Edward M. Bryant disclose a double sided golf club head with a putting face and a chipping face. Such disclosed golf clubs are intended to augment conventional sets of "irons" and are useful when the golf ball lies relatively close to a green-the chipping side of the club head first being used to chip the ball onto the green and the putting side then being used to putt the ball to and into the cup. In this regard a golfer typically otherwise carries both a chipping iron and a putter in closely approaching a green. After the ball is chipped onto the green, the chipping iron is typically dropped and the hole finished with the putter. This frequently results in the chipping iron being forgotten and sometimes lost.

Except for the above-cited published application to Hsu, the above-cited publication and patents disclose a club shaft that is rigidly mounted to a double-faced club head, the Sundin and Hattori patents disclosing a vertically mounted shaft which is disadvantageous for chipping use of the club and the Bryant design patent disclosing a fixed angle shaft which would be disadvantageous for use of the club for both chipping and putting.

The Hsu patent discloses a club shaft that is pivotally attached to the double-faced club head so that the shaft angle can be selectively adjusted as to angle by the golfer according to which club head face is to be used. However, no mechanism is provided for assuring that the same shaft angle is set each time a particular club head face is selected for use, and the set shaft angle is maintained only by friction between the shaft and club head. Thus, in time, it is likely that the frictional attachment between the shaft and club head will become worn to an extent that a set shaft angle cannot be maintained and ball chipping and putting will become erratic.

For these and other reasons, a principle objective of the present invention is to provide a dual-purpose golf club with a club head having opposing chipping and putting faces and having a fixed angle shaft that is reversible relative to the club head.

SUMMARY OF THE INVENTION

A combination chipper and putter golf club comprises a club head having a generally flat upper surface and having a vertical ball putting side surface and an opposing, angled ball chipping side surface, the club head having a bore formed therethrough perpendicular to its upper surface. Included is a hostel having an elongate, generally flat club head attachment region and an upwardly angled club shaft region, the club head attachment region having a depending shaft region sized for being received into the club head bore. Detent means are configured for releasably retaining the hosel in either of two, 180 degree apart positions relative to the club head, according to the ball striking side surface selected for use. Means are disposed in the bore for urging the hostel club head attachment region against the club head upper surface with the hosel received in a selected one of the detent positions, while enabling the hosel to be lifted from the club head a distance sufficient to thereby enable the hosel to be pivoted 180 degrees to the other one of the detent positions.

The means for urging the hosel club head attachment region against the club head upper surface preferably includes a tension spring disposed in the bore, the spring being attached in a normally stretched condition between a lower end of the hosel depending shaft region and a plug closing a lower end of the club head bore.

An elongate tube extension may be fixed to the hosel shaft region, the tube being sized to closely fit into, and rotate in, the club head bore. The detent means may then comprise two opposing detent notches formed upwardly into a lower end of the tube extension, and the bore closing plug is formed having a raised region sized for fitting into the tube notches. Also, tension spring is installed through the tube extension and is attached to a swivel extending downwardly from the hosel shaft region.

Alternatively, the club head bore is stepped having an upper bore region sized to receive the hosel depending shaft region and a larger diameter lower bore region. In which case, the means for urging the hosel club head attachment region against the club head upper surface includes a compression spring disposed in the bore around the hosel depending shaft region, the spring being confined in a normally compressed condition between a shoulder formed between the bore upper and lower regions and a retainer attached to a lower end of the hosel depending shaft region. The detent means comprise detent protrusions depending from opposite sides of said hosel pivot shaft region and mating detent recesses formed into the club head from its upper surface.

In another version in which the club head bore is stepped having an upper bore region sized to receive the hosel pivot shaft and a larger diameter lower bore region, the means for urging the hosel club head attachment region against the club head upper surface includes a magnet disposed in the bore lower region and attached to a lower end of the hosel pivot shaft region and above a magnetic metal disc installed in a lower end of the club head bore. A washer is attached to the lower end of the hosel pivot shaft region, the magnet being attached to the washer. The washer abuts a shoulder formed between the bore upper and lower regions when the hosel pivot shaft region is withdrawn from the bore a distance sufficient to enable said 180 degree rotation of the hosel.

The club head bore is located generally at the center of the club head and the club head chipping side is preferably formed at an angle of between about 70 degrees and about 85 degrees from the club head upper surface.

A combination chipper and putter golf club thus comprises a club head having a generally flat upper surface and having a vertical ball putting side surface and an opposing, angled ball chipping side surface, the club head having a bore formed perpendicularly therethrough. An included hostel has an elongate club head attachment region and an upwardly angled club shaft region, the club head attachment region having a short depending shaft region. A tubular extension has an upper end and a lower end, the upper end of which is fixed to the hosel depending shaft region. The tubular extension is sized to fit closely into the club head bore, being rotatably installed therein. The tubular extension has a detent notch formed upwardly into the its lower end; a plug installed at a lower end of the bore has a raised portion for receiving the tubular extension detent notch. A tension spring connected between a lower end of the hosel depending shaft region and the bore bottom plug extends through the tubular extension. The spring urges the hosel club head attachment region against the club head upper surface with the plug raised portion receiving the tubular extension detent notch, while enabling the hosel tubular extension to be withdrawn from the bore a distance sufficient to release the detent notch from the plug raised portion to thereby enable the hosel to be pivoted 180 degrees relative to the club head.

The tubular extension may be formed having an opposing pair of detent notches formed upwardly into the lower tubular end. Preferably the tension spring is rotatably connected to a swivel extending downwardly from said hosel depending shaft region.

Specifically, a combination chipper and putter golf club comprises a club head having a generally flat upper surface with a vertical ball putting side surface and an opposing, angled ball chipping side surface and having a bore formed perpendicularly therethrough. First and second detent recesses are formed downwardly into the club head from its upper surface, the detent recesses being located at identical distances to opposite sides of the bore.

Included is a hostel having a club head attachment region and an upwardly angled club shaft region. The club attachment region has a depending pivot shaft region sized for being slidingly received into the club head bore and has a pair of depending detent protuberances located to opposite sides thereof, the detent protuberances being sized to fit into the club head detent recesses when the pivot shaft region is fully received into the bore. Means, comprising a spring, are disposed in the bore for urging the hostel pivot shaft region into the bore until the hostel club head attachment region abuts the club head upper surface with the detent protuberances received into the detent recesses, while enabling the pivot shaft region to be withdrawn from the bore a distance sufficient to withdraw the detent protuberances from the detent recesses so as to permit the hosel to be pivoted 180 degrees relative to the club head.

The spring may be a tension spring connected between a lower end of the hosel pivot shaft and a plug installed to close a lower end of the bore.

The bore may be stepped, having an upper region for receiving the hosel pivot shaft and an enlarged diameter lower region, the spring then be a compression spring confined in a compressed condition between a shoulder at an intersection of the bore upper and lower regions and a retainer fixed to a lower end of the hosel pivot shaft region.

Further, a combination chipper and putter golf club comprises a club head having a flat upper surface and having a vertical ball putting side surface and an opposing, angled ball chipping side surface, the club head having a stepped bore formed perpendicularly therethrough. The stepped bore has an upper region and a larger diameter lower region, and has first and second detent recesses formed downwardly thereinto from the upper surface and located at identical distances to opposite sides of the bore. Included is a hostel having a club head attachment region and an upwardly angled club shaft region, the club attachment region having a depending pivot shaft region sized for being slidingly received into the club head bore upper region and extending into the stepped bore lower region, and having a depending detent protuberance located to fit into one of the detent recesses when the pivot shaft region is fully received into the stepped bore. Means are disposed in the stepped bore lower region for urging the hostel pivot shaft region into said stepped bore with the hostel club head attachment region against the club head upper surface and with the detent protuberance received into one of the detent recesses, while enabling the pivot shaft region to be withdrawn from the bore a distance sufficient to withdraw the detent protuberance from the detent recess so as to permit the hosel to be pivoted 180 degrees relative to the club head. The means comprises a magnet attached to a lower end of the hosel pivot shaft region and a magnetic material plug disc installed in a lower end of the stepped bore lower region and includes a washer attached to the lower end of the hosel pivot shaft region for limiting a withdrawal distance of the hosel pivot shaft from the stepped bore by abutting a shoulder region between the bore upper and lower regions.

Preferably the detent recesses are formed adjacent the bore and the bore is located at a center of said golf club head upper surface and the hosel club head attachment region is formed having two depending detent protuberances located to fit into the two club head recesses when the hosel pivot shaft region is received into the stepped bore.

BRIEF DESCRIPTION OF THE DRAWINGS

The present invention can be more readily understood by a consideration of the following detailed description when taken in conjunction with the accompanying drawings, in which.

In the various FIGS. the same elements and features are given the same reference number and corresponding elements and features are given the original reference numbers followed by an "a", "b" or "c" as appropriate.

DESCRIPTION OF THE PREFERRED EMBODIMENT

Figure 1A:
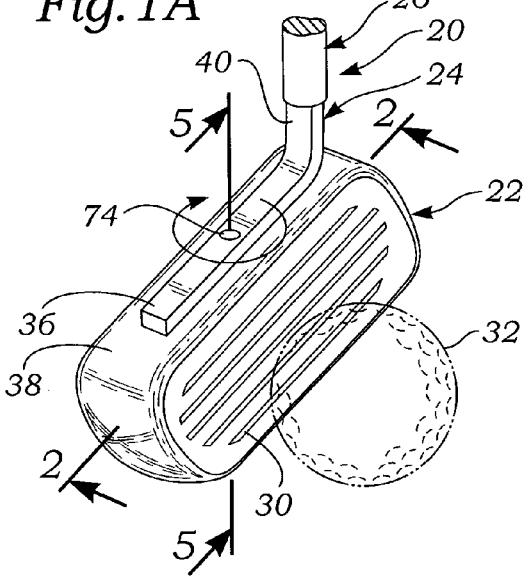
FIG. 1A showing the club hosel oriented on the club head so that a club head chipping face is positioned for addressing a golf ball, and FIG. 1B showing the club hosel oriented on the club head so that a club head putting face is positioned for addressing the golf ball.
Figure 1B:
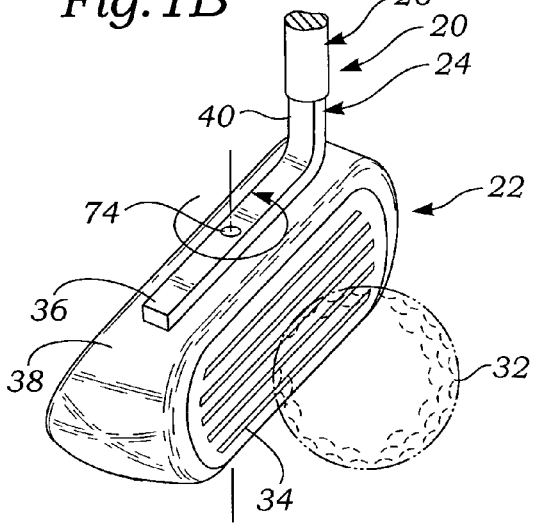
FIG. 1 includes two perspective views of a club head region of the dual-purpose, combination chipper and putter golf club of the present invention.

There is shown in FIGS. 1A and 1B a dual purpose, combination chipper and putter golf club 20 comprising a combination chipper and putter club head 22, a hosel 24 connected (as more particularly described below) to the club head and a club shaft 26 (only lower regions of which are shown) that is joined to the hosel.

Club head 22 is formed having an angled chipping face 30 shown contacting a golf ball 32 in FIG. 1A and an opposite, vertical putting face 34 shown contacting the golf ball in FIG. 1B.

Figure 2:
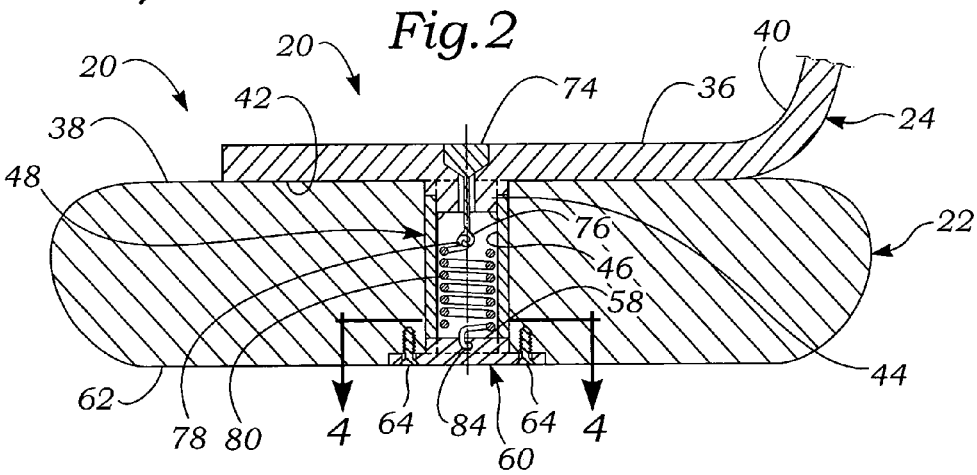
FIG. 2 is a longitudinal cross sectional drawing taken along line 2—2 of FIG. 1A, showing a tubular extension of a hosel depending shaft region received into a vertical club head bore, showing a detent arrangement at the bottom of the tubular extension and showing a stretched tension spring connected between the hosel depending shaft region and a plate covering the bottom of the club head bore.
Figure 6:
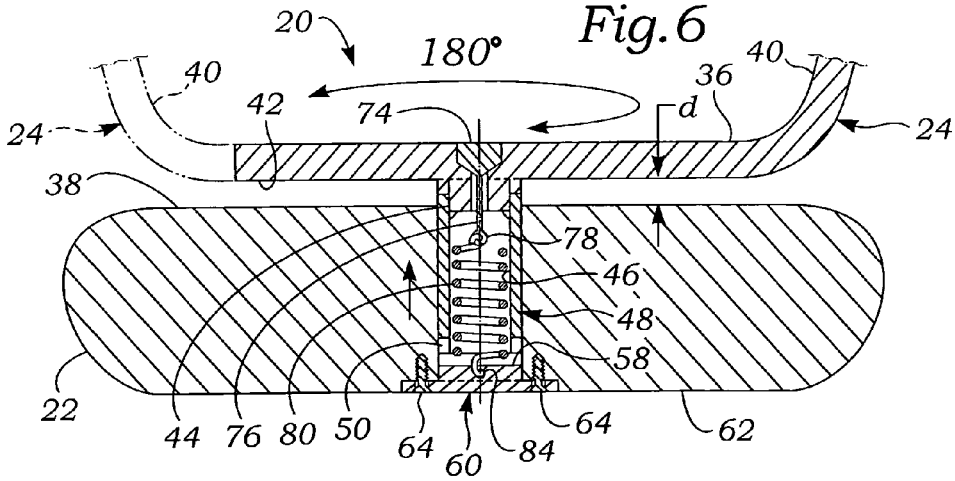
FIG. 6 is a longitudinal cross sectional drawing corresponding to FIG. 2 showing the hosel lifted a sufficient distance upwardly against the tension spring relative to the club head to withdraw the tubular detent recesses from mating detent regions of the bottom cover plate so the hosel can be rotated 180 degrees relative to the club head to the alternative detent locking position shown in phantom lines.
Figure 4:
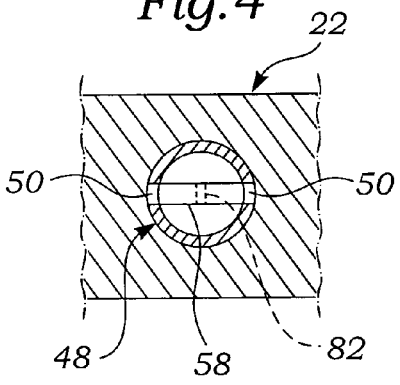
FIG. 4 is a cross sectional drawing looking along line 4—4 of FIG. 2, showing features of the bottom cover plate.
Figure 3:
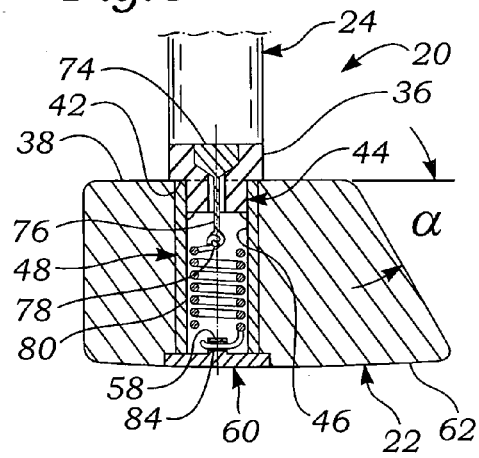
FIG. 3 is a transverse cross sectional drawing taken along line 3—3 of FIG. 1A, and corresponding to the longitudinal cross sectional drawing of FIG. 2, showing the tubular extension of the hosel depending shaft region received into the club head bore and showing the tension spring stretched between the hosel depending shaft region and the bottom cover plate.

As depicted in FIG. 1 and in the longitudinal cross section of FIGS. 2 and 6 and the transverse cross section of FIG. 3, hosel 24 is formed having an elongate, relatively straight and slender club head attachment region 36 that, in club use, sits on a club head flat upper surface 38 and having an upwardly-angled region 40 to which shaft 26 is joined. Depending vertically from an under surface 42 of hosel region 36 is a cylindrical shaft 44 which is received closely into a vertical club head central, circular bore 46 (FIGS. 2, 3 and 6). As shown in FIG. 3, chipping face 30 is formed at an angle, $\alpha$, relative to club head upper surface, that is preferably between about 70 degrees and about 85 degrees.

A bore 46 is formed through club head 22 perpendicular to club head upper surface 38 in a generally central location of the club head. Shown connected, as by spot or laser welding, to hosel depending shaft 44 is an elongate tubular extension 48 which fits closely into bore 46 and is rotatable therein.

Figure 5:
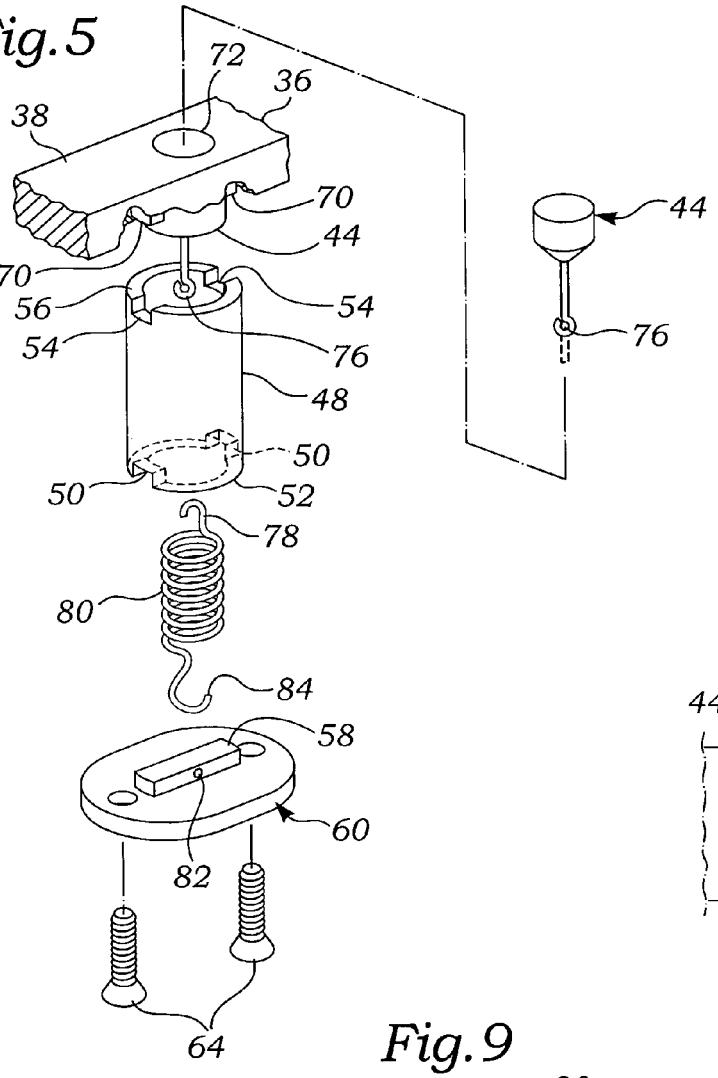
FIG. 5 is an exploded perspective drawing showing portions of the hosel with the depending shaft region and the tubular that is joined thereto, the tubular extension having detent recesses formed at its lower end and having corresponding keying recesses formed at its upper end, and showing a central raised region of the bottom cover plate which cooperates with the tubular extension detent recesses, and further showing features and orientation of the tension spring.
Figure 10:
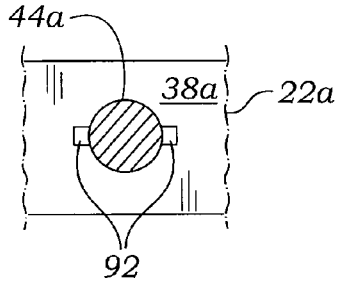
FIG. 10 is a view taken along line 10—10 of FIG. 9, showing the detent recesses formed into the first variation club head to opposites sides of the club head bore.

As best seen in FIG. 5, tubular extension 48 has an opposing pair of detent recesses or notches 50 formed upwardly thereinto from a bottom surface 52. A corresponding, similarly oriented, pair of keying recesses or notches 54 are formed downwardly into tubular extension 48 from an upper surface 56, and are located directly above detent notches 50, for the purpose described below. Detent notches 50 are sized to be received by an upwardly extending bar region 58 of a bottom plate 60 so as to provide a detent arrangement. Bottom plate 60 is recessed into club head 22 from a bottom surface 62 thereof to close bore 46, and is retained in club head 22 by a pair of screws 64. Tubular extension keying notches 54 are received in a pair of projections 70 formed in hosel region 36 adjacent shaft 44 and function to provide proper orientation of detent notches 50 when tubular extension 48 is joined to the hosel shaft. Shown installed downwardly through an aperture 72 formed through hosel region 36 and shaft 44 is a swivel member 74 having a depending hook portion 76 for the connection of an upper end 78 of an associated tension spring 80. A small hole 82 is formed in bottom plate bar region 58 for receiving a hook 84 at the lower end of spring 80.

For assembly, as shown in FIGS. 2, 3 and 6, and as apparent from FIG. 5, spring upper end 78 is connected to swivel loop portion 76 and tubular extension 48 is installed over spring 80 and is joined to hosel shaft 44 with keying notches 54 received into projections 70 for proper keying of the tubular extension to the hosel shaft. With tubular extension 48 received into club head bore 46, spring 80 is manually stretched and spring lower end hook 84 is inserted through hole 82 in bottom plate bar region 58 and bottom plate 60 is installed in club head 22 and retained therein by screws 64.

Assembled in the above-described manner and as shown in FIG. 2, tensioned spring 80, pulls (urges) hosel region 36 tightly against club head upper surface 38 (with hosel lower surface 42 against such upper surface). With tubular extension detent notches 50 engaging bottom plate bar region 58, hosel 24 is fixed against any rotational movement relative to club head 22 and golf club 20 is ready for chipping golf ball 32 by chipping surface 30 (FIG. 1A).

As shown in FIG. 6, to prepare golf club 20 for putting, hosel 24 is manually lifted upwardly from club head 22, against tension of spring 80, a distance, d, sufficient to release tubular extension detent notches 50 from bottom plate bar region 58. Hosel 24 is then rotated 180 degrees in either rotational direction to an opposite position relative to club head 24 (as shown in plantom lines) and is then released to cause tubular extension detent notches 50 to again be received by bottom plate bar region so as to relock the hosel in position for use of golf club 20 for putting ball 32 (FIG. 1B).

First Variation of FIGS. 7–10:

A first variation golf club 20*a* is depicted in FIGS. 7–10. As shown, golf club 20*a* is basically the same as golf club 20 except that tubular extension 48 is not used, hosel depending shaft 44*a* is increased in length, and locking detents (described below) are formed at the top of a club head 22*a*.

Figure 7:
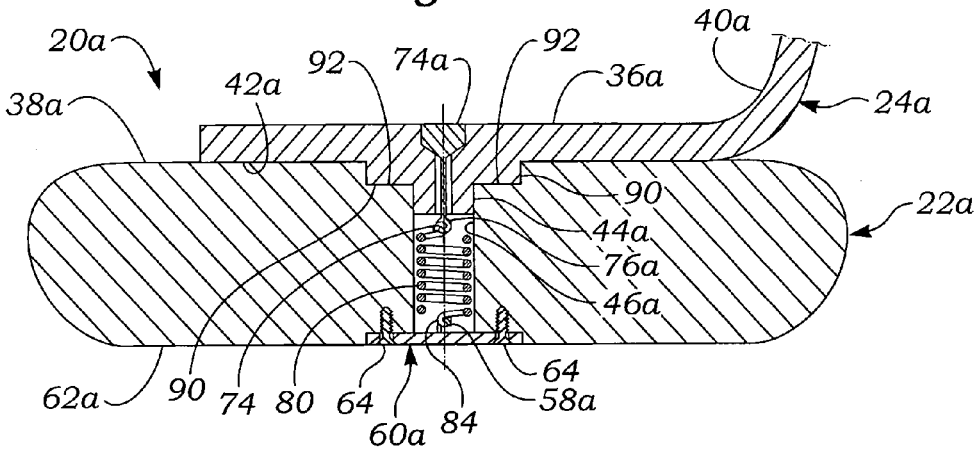
FIG. 7 is a longitudinal cross sectional drawing corresponding to FIG. 2 of a first variation combination golf club, showing a depending pivot shaft region of the variation club hosel received in a vertical club head bore, showing depending detent projections formed adjacent opposite side regions of the hosel pivot shaft, showing mating detent recesses formed into the club head, and showing a tension spring connected to the bottom of the hosel pivot shaft from a bore bottom cover for urging the hosel against an upper surface of the club head.
Figure 9:
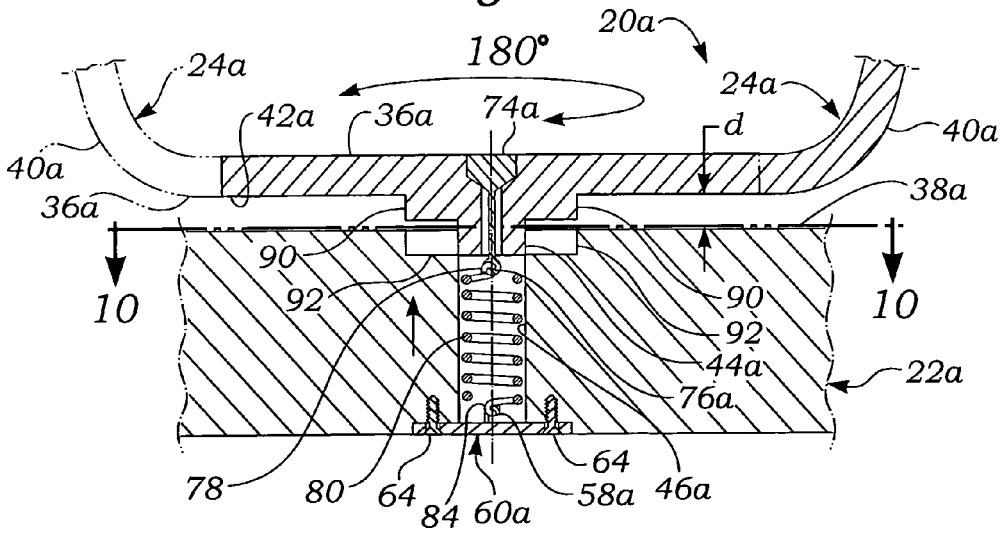
FIG. 9 is a transverse cross sectional drawing corresponding to FIG. 7, showing the hosel lifted upwardly from the club head upper surface against the tension spring a sufficient distance to enable the hosel to be rotated 180 degrees to the opposite end of the club head, as depicted in phantom lines.
Figure 11:
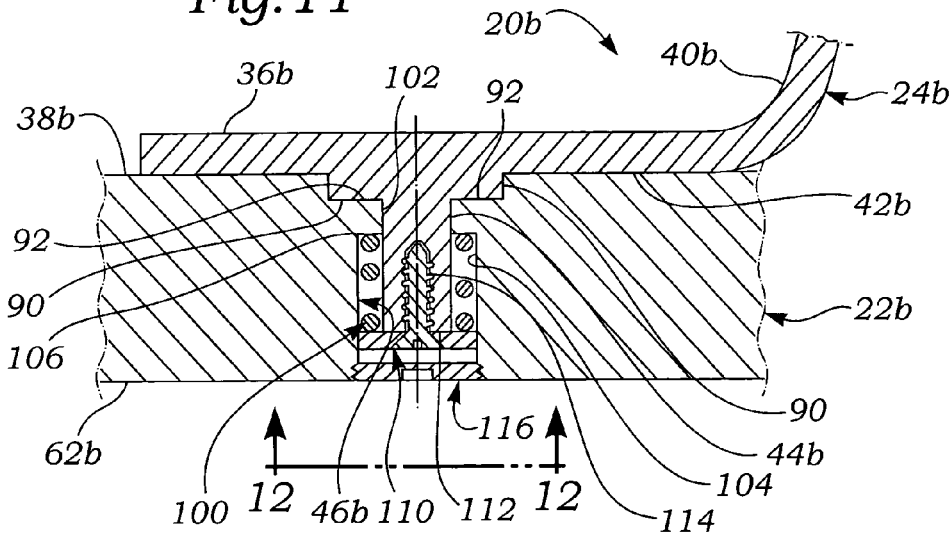
FIG. 11 is a longitudinal cross sectional drawing corresponding generally to FIG. 2, of a second variation combination golf club, showing a stepped bore through the club head and showing the hosel resiliently connected to the club head by a compression spring installed around the hosel pivot shaft.

Located to opposite sides of hosel shaft 44*a* are respective first and second depending detent protrusions or protuberances 90 which are generally rectangular in shape. Although two such detent protrusions 90 are shown, it will be appreciated that only one of the detent protrusions may be provided. As shown in FIGS. 7 and 9, club head 22*a* is formed having respective first and second rectangular recesses 92 at opposite side of a vertical bore 46*a*. Recesses 92 are open to a club head upper surface 38*a* and are shaped to closely receive detent protrusions 90 when a lower surface 42*a* of a hosel region 36*a* is against the club head upper surface.

Figure 8:
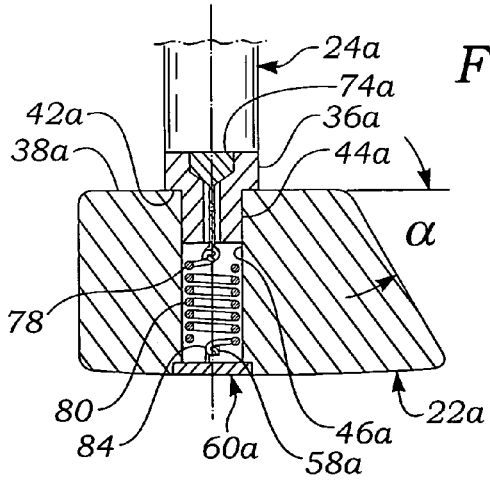
FIG. 8 is a transverse cross sectional drawing corresponding to FIG. 3, also showing the depending pivot shaft region of the variation club hosel received in the vertical club head bore and showing the tension spring connected to the hosel shaft for urging the hosel against the upper surface of the club head, further showing opposing putting and chipping faces of the club head.

Hosel region under surface 42*a* is held tightly against club head upper surface 38*a* by tension spring 80 installed in club head bore 46*a* (FIGS. 7–8). As shown, upper end 78 of tension spring 80 is pivotally connected to a downwardly extending portion 76*a* of a swivel member 74*a* installed through hosel region 36*a* and depending shaft region 44*a*. Lower end 84 of tension spring 80 is connected to an upwardly-extending bar region 58 of a bottom plate 60*a* which is secured to club head 22*a* by screws flush with a bottom surface 62*a* of club head 22.

Golf club 20*a* is operated in the manner described above for golf club 20 with respect to repositioning hosel 24*a* relative to club head 22*a*. Thus, as depicted in FIG. 9, hosel 24*a* is lifted upwardly from club head 22*a*, against tension in spring 80, a distance, d, sufficient to withdraw detent protrusions 90 from detent recesses 92. Hosel 24*a* is then rotated 180 degrees in either rotational direction to the hosel position depicted in phantom lines and is released so that detent protuberances 90 are again received in detent recesses 92, thereby locking the hosel in its new position.

Figure 12:
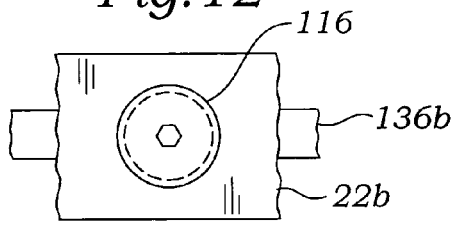
FIG. 12 is a view looking along line 12—12 of FIG. 11, showing a screw-in plug disc installed in the lower end of the club head stepped bore.
Figure 13:
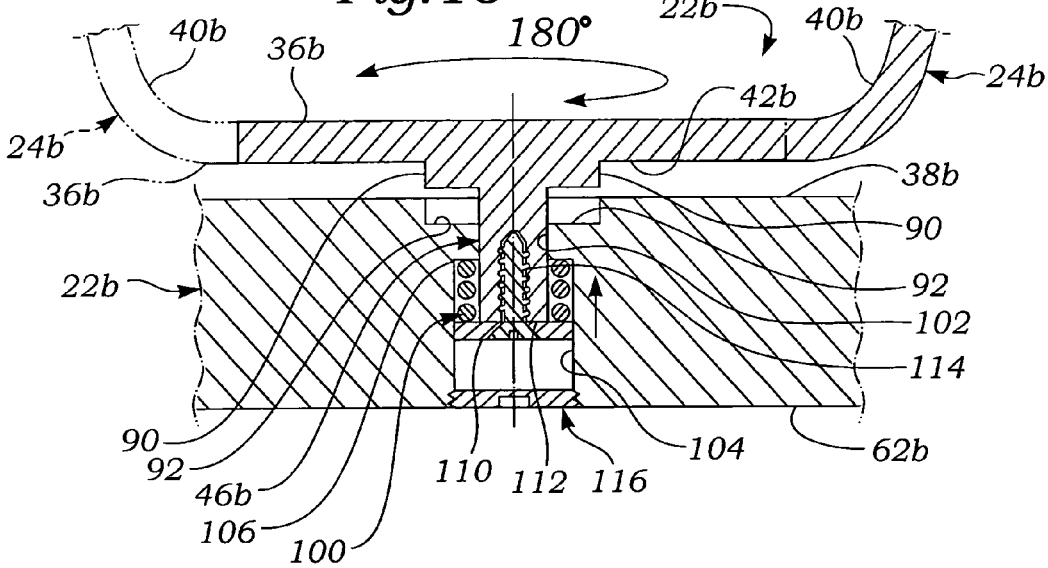
FIG. 13 is a longitudinal cross sectional drawing corresponding generally to FIG. 6, showing the second variation hosel lifted upwardly from the club head upper surface against the compression spring a sufficient distance to enable the hosel to be rotated 180 degrees to the opposite end of the club head, as depicted in phantom lines.
Figure 14:
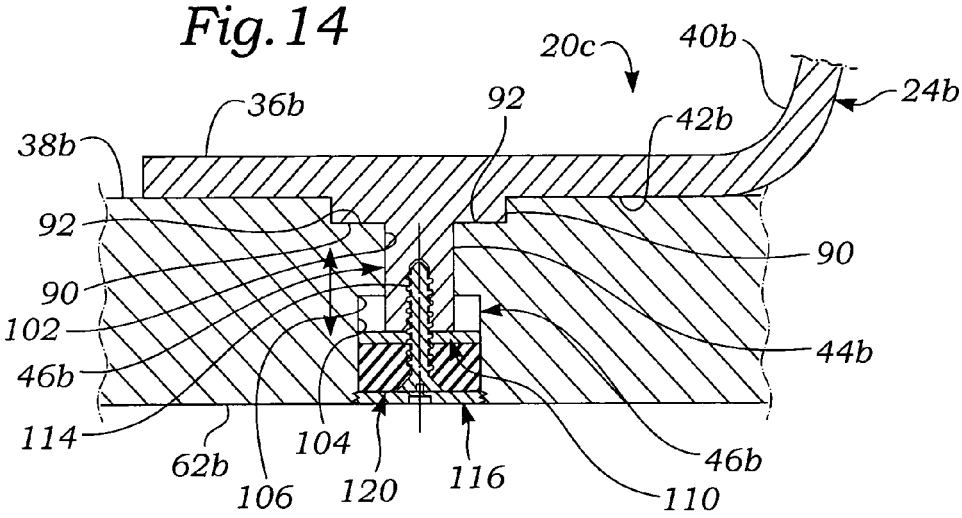
FIG. 14 is a longitudinal cross sectional drawing corresponding generally to FIG. 11 of a third variation combination golf club, showing a stepped bore through the club head and showing the third variation hosel held to the club head by a magnet connected to the lower end of the hosel pivot shaft.

Second Variation of FIGS. 12–14:

A second variation golf club 20*b* is depicted in FIGS. 12–14. As shown, golf club 20*b* is similar as above-described golf clubs 20 and 20*a*, except as described below, the basic difference being that instead of using tension spring 80, a compression spring 100 is installed in a stepped bore 46*b* in a club head 22*b*. Located to opposite sides of a longer hosel shaft 44*b* are respective first and second depending detent protrusions 90 which are generally rectangular in shape. Although two such detent protrusions 90, it will be appreciated that only one of the detent protrusions may be provided. As shown in FIGS. 12 and 14, club head 22*b* is formed having respective first and second rectangular recesses 92 at opposite side of an upper region 102 of a vertical bore 46*b*. Recesses 92 are open to a club head upper surface 38*b* and are shaped to closely receive detent protrusions 90 when a lower surface 42*b* of a hosel region 36*b* is against the club head upper surface.

Upper bore region 102 is sized to closely receive hosel pivot shaft 44*b*; a larger diameter bore lower region 104 is sized to receive compression spring 100. Compression spring 100 is installed around hosel shaft 44*b* and is held in a normally compressed condition between a bore shoulder 106 at the juncture between upper and lower bore regions 102 and 104 and a retainer washer 110 attached to a bottom surface 112 of the hosel shaft by a screw 114. In such compressed condition of compression spring 100, hosel 24*b* is held firmly against club head upper surface 38*b* with detent protrusions 90 received in detent recesses 92. A bottom plate 116 is threaded into club head 22*b* to close a lower opening of bore lower region 104 (FIG. 13).

Repositioning of hosel 24*b* into the 180 degree position (shown in phantom lines in FIG. 14) is accomplished in the manner described above for hosels 24 and 24*a* of golf clubs 20 and 20*a*, except that the lifting of hosel 24*b* to clear hosel detent protrusions 90 from club head detent recesses 92 is against increased compression of compression spring 100. After such 180 degree rotation, hosel 24*b* is released so that hosel detent protrusions 90 are again received in club head recesses 92 and lower surface 42*b* of hosel region 36*b* again bears against club head upper surface 38*b*, the hosel being pulled down into and held in such new position by compression of compression spring 100.

Figure 15:
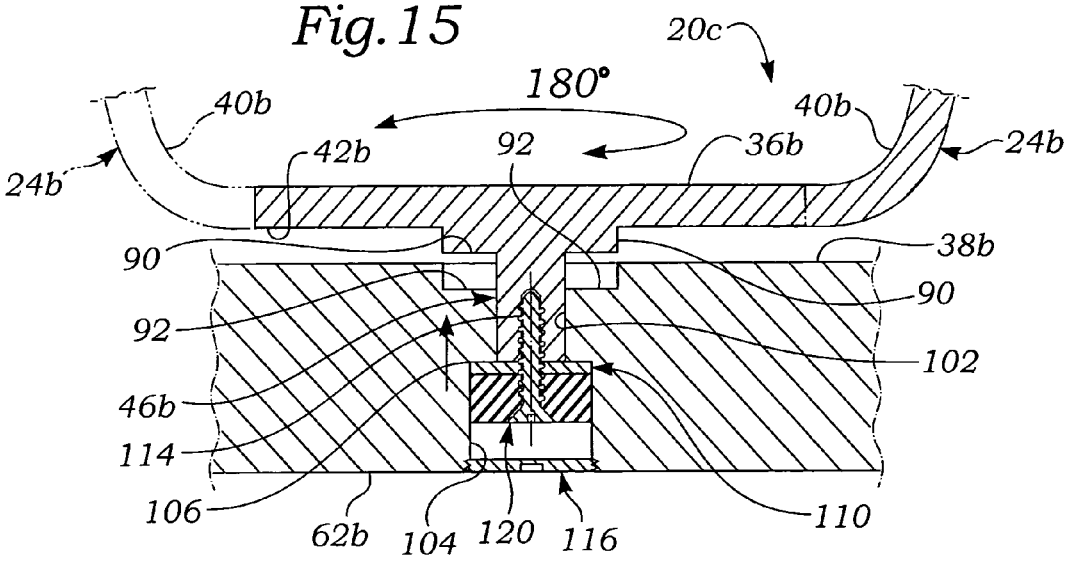
FIG. 15 is a longitudinal cross sectional drawing corresponding generally to FIG. 13, showing the third variation hosel lifted upwardly from the club head upper surface against the force of the magnet a sufficient distance to enable the hosel to be rotated 180 degrees to the opposite end of the club head, as depicted in phantom lines.

Third Variation of FIGS. 15–16:

FIGS. 15–16 depict a third variation dual-purpose, combination chipper and putter golf club 20*c* which is essentially identical to above-described golf club 20*b* except as specifically described below. As more particularly described below, the basic difference between golf clubs 20*c* and 20*b* is that a hosel 24*c* of third variation golf club is held against a club head 22*c* by a disc-shaped magnet 120 instead of by above-described compression spring 100.

Club head bore 46*b* has upper bore region 102*b* sized to closely receive hosel pivot shaft 44*b* and a larger diameter lower region 104*b* sized to receive magnet 120 and a protective washer 110. Magnet 120 and washer 110 are attached to a bottom surface 112 of hosel shaft 44*b* by screw 114. Disc-shaped plug 116, which is made from a ferrous alloy, is threaded into club head 22*b* at the lower end of bore lower region 104 and is contacted by magnet 100 to thereby firmly hold hosel 24*b* against club head upper surface 38*b*, as depicted in FIG. 15.

Repositioning of hosel 24*b* into the 180 degree position (shown in phantom lines in FIG. 16) is accomplished in the manner described above for hosel 24 and 24*a*, except that the lifting of hosel 24*b* to clear hosel detent protrusions 90 from club head detent recesses 92 is against the magnet force between magnet 120 and plug 116. Upward lifting of hosel 24*b* is limited by washer 1110 reaching shoulder 106 at the intersection of bore upper and lower regions 102 and 104. Hosel 24*b* is then released so that hosel detent protrusions 90 are again received into club head detent recesses 92 and lower surface 42*b* of hosel region 36*b* again bears against club head upper surface 38*b*, the hosel being held in such new position by magnet attraction between magnet 120 and plug 116.

It will be appreciated that hosel 24, 24*a*, 24*b* and 24*c*, as well as club head 22, 22*a*, 22*b* and 22*c*, may be constructed from any strong, rigid material, including, but not limited to, brass, hard aluminum alloy, stainless steel and titanium or a strong, rigid polymeric plastic material.

Thus, although there is described and illustrated herein a dual purpose, combination chipper and putter golf club and variations thereof, for purposes of illustrating the manner in which the present invention may be used to advantage, it is to be understood that the invention is not limited thereto. Consequently, any and all variations and equivalent arrangements which may occur to those skilled in the applicable art are to be considered to be within the scope and spirit of the invention as set forth in the claims which are appended hereto as part of this application.

What is claimed is:

1. A combination chipper and putter golf club which comprises:

a. a club head having a generally flat upper surface and having a vertical ball putting side surface and an opposing, angled ball chipping side surface, said club head having a bore formed therethrough perpendicular to said upper surface;

b. hosel having an elongate, generally flat club head attachment region and an upwardly angled club shaft region, said club head attachment region having a depending shaft region sized for being received into said club head bore;

c. detent means configured for releasably retaining said hosel in either of two, 180 degree apart, positions relative to said club head according to the ball striking surface to be used;

d. means disposed in said bore for urging said hosel club head attachment region against said club head upper surface with the hosel received in a selected one of said detent positions, while enabling said hosel to be lifted from said club head a distance sufficient to thereby enable the hosel to be pivoted 180 degrees to the other one of said detent positions;

e. said means for urging said hosel club head attachment region against said club head upper surface including a tension spring disposed in said bore, said spring being attached in a normally stretched condition between a lower end of the hosel depending shaft region and a plug closing a lower end of the club head bore; and f. an elongate tube extension fixed to said hosel depending shaft region, said tube extension being sized to closely fit into, and rotate in, said club head bore.

2. The combination chipper and putter golf club as claimed in claim 1, wherein said detent means comprise two opposing detent notches formed upwardly into a lower end of said tube extension and wherein said bore closing plug is formed having a raised region sized for fitting into said tube extension notches.

3. The combination chipper and putter golf club as claimed in claim 1, wherein said tension spring is installed through said tube extension.

4. The combination chipper and putter golf club as claimed in claim 1, wherein said tension spring is attached to a swivel extending downwardly from said hosel depending shaft region.

5. The combination chipper and putter golf club as claimed in claim 1, wherein said club head bore is stepped bore having an upper bore region sized to receive said hosel depending shaft region and a larger diameter lower bore region, and wherein said means for urging said hosel club head attachment region against said club head upper surface includes a compression spring disposed in said bore around said hosel depending shaft region, said spring being confined in a normally compressed condition between a shoulder formed between said bore upper and lower regions and a retainer attached to a lower end of the hosel depending shaft region.

6. The combination chipper and putter golf club as claimed in claim 1, wherein said club head bore is s stepped bore having an upper bore region sized to receive said hosel depending shaft region and a larger diameter lower bore region, and wherein said means for urging the hosel club head attachment region against said club head upper surface includes a magnet disposed in the bore lower region and attached to a lower end of the hosel depending shaft region and a magnetic metal disc installed in a lower end of the club head bore.

7. The combination chipper and putter golf club as claimed in claim 6, including a washer attached to the lower end of the hosel depending shaft region, said magnet being attached to said washer, said washer abutting a shoulder formed between the bore upper and lower regions when the hosel depending shaft region is withdrawn from said bore a distance sufficient to enable said 180 degree rotation of the hosel.

8. The combination chipper and putter golf club as claimed in claim 1, wherein said club head bore is located generally at a center of the club head.

9. The combination chipper and putter golf club as claimed in claim 1, wherein said detent means comprise detent protrusions depending from opposite sides of said hosel depending shaft region and mating detent recesses formed into the club head.

10. The combination chipper and putter golf club as claimed in claim 1, wherein said club head chipping side surface is formed at an angle of between about 70 degrees and about 85 degrees from the club head upper surface.

11. A combination chipper and putter golf club which comprises:

a. a club head having a generally flat upper surface and having a vertical ball putting side surface and an opposing, angled ball chipping side surface, said club head having a bore formed perpendicularly therethrough;

b. a hosel having an elongate club head attachment region and an upwardly angled club shaft region, said club head attachment region having a short depending shaft region;

c. a tube extension having an upper end and a lower end, the upper tube end being fixed to said hosel depending shaft region, said tube extension being sized to fit closely into said club head bore and being rotatably installed therein, said tube extension having a detent notch formed upwardly into the tube lower end;

d. a plug installed at a lower end of said bore, said plug having a raised portion for receiving said tube extension detent notch; and e. a tension spring connected between a lower end of said hosel depending shaft region and said bore bottom plug and extending through said tube, said spring urging said hosel club head attachment region against said club head upper surface and with said plug raised portion receiving said tube extension detent notch, while enabling said hosel tube extension to be withdrawn from said bore a distant sufficient to release said tube detent notch from said plug raised portion to thereby enable the hosel to be pivoted 180 degrees relative to the club head.

12. The combination chipper and putter golf club as claimed in claim 11, wherein said tube extension is formed having an opposing pair of detent notches formed upwardly into the lower end thereof.

13. The combination chipper and putter golf club as claimed in claim 11, wherein said tension spring is rotatably connected to a swivel extending downwardly from said hosel depending shaft region.

14. A combination chipper and putter golf club which comprises:

a. a club head having a generally flat upper surface and having a vertical ball putting side surface and an opposing, angled ball chipping side surface, said club head having a bore formed perpendicularly therethrough, and further having first and second detent recesses formed downwardly thereinto from said upper surface, said detent recesses being located at identical distances to opposite sides of said bore;

b. a hosel having a club head attachment region and an upwardly angled club shaft region, said club attachment region having a depending pivot shaft region sized for being slidingly received into said club head bore and having a pair of depending detent protuberances located to opposite sides of said pivot shaft, said detent protuberances being sized to fit into said club head detent recesses when said pivot shaft region is fully received into said bore; and c. means disposed in said bore for urging said hosel pivot shaft region into said bore until the hosel club head attachment region abuts said club head upper surface with said detent protuberances received into said detent recesses, while enabling said pivot shaft region to be withdrawn from said stepped bore a distance sufficient to withdraw said detent protuberances from said detent recesses so as to permit the hosel to be pivoted 180 degrees relative to the club head, said means comprising a spring disposed in said bore.

15. The combination chipper and putter golf club as claimed in claim 14, wherein said spring is a tension spring connected between a lower end of said hosel pivot shaft and a plug installed to close a lower end of said bore.

16. The combination chipper and putter golf club as claimed in claim 14, wherein said bore is stepped, having an upper region for receiving the hosel pivot shaft and an enlarged diameter lower region, and wherein said spring is a compression spring, said compression spring being confined in a compressed condition between s shoulder at an intersection of said bore upper and lower regions and a retainer fixed to a lower end of the hosel pivot shaft region.

17. A combination chipper and putter golf club which comprises:

a. a club head having a flat upper surface and having a vertical ball putting side surface and an opposing, angled ball chipping side surface, said club head having a stepped bore formed perpendicularly therethrough, said bore having an upper region and a larger diameter lower region, said club head further having first and second detent recesses formed downwardly thereinto from said upper surface, said detent recesses being located at identical distances to opposite sides of said bore;

b. a hosel having a club head attachment region and an upwardly angled club shaft region, said club attachment region having a depending pivot shaft region sized for being slidingly received into said club head bore upper region and extending into said stepped bore lower region, and having a depending detent protuberance located to fit into one of said detent recess when said pivot shaft region is fully received into said stepped bore; and c. means disposed in said stepped bore lower region for urging said hosel pivot shaft region into said stepped bore with the hosel club head attachment region against said club head upper surface and with said detent protuberance received into said one of the detent recesses, while enabling said pivot shaft region to be withdrawn from said bore a distance sufficient to withdraw said detent protuberance from said one detent recess so as to permit the hosel to be pivoted 180 degrees relative to the club head, said means comprising a magnet attached to a lower end of the hosel pivot shaft region and a plug disc installed in a lower end of the stepped bore lower region, said disc being made of a magnetic metal.

18. The combination chipper and putter golf club as claimed in claim 17, wherein said pivot shaft urging means includes a washer attached to the lower end of the hosel pivot shaft region for limiting a withdrawal distance of the hosel pivot shaft from the stepped bore by abutting a shoulder region between said bore upper and lower regions.

19. The combination chipper and putter golf club as claimed in claim 17, wherein said club head bore and said detent recesses are formed adjacent said bore and the bore is located at a center of said golf club head upper surface.

20. The combination chipper and putter golf club as claimed in claim 17, wherein said hosel club head attachment region is formed having two depending detent protuberances located to fit into said two club head recesses when the hosel pivot shaft region is received into said stepped bore.

21. A combination chipper and putter golf club which comprises:

a. a club head having a generally flat upper surface and having a vertical ball putting side surface and an opposing, angled ball chipping side surface, said club head having a bore formed therethrough perpendicular to said upper surface;

b. a hosel having an elongate, generally flat club head attachment region and an upwardly angled club shaft region, said club head attachment region having a depending shaft region located and sized for being pivotally received into said club head bore;

c. means for releasably retaining said hosel in either of two, 180 apart, positions relative to said club head corresponding to the ball striking surface to be used, said hosel being pivotable on said depending shaft between said two positions; and d. means for retaining said depending shaft in said club head bore, so as to prevent the release of said hosel region from the club head, said retaining means including two detent recesses formed downwardly into the club head upper surface and at least one detent projection depending from said hosel club head attachment region positioned and sized for being received into said detent recesses.

* * * * *